US006105321A

United States Patent [19]

KarisAllen et al.

[11] Patent Number: 6,105,321

[45] Date of Patent: Aug. 22, 2000

[54] PRESTRESSED WOOD COMPOSITE LAMINATE

[76] Inventors: Kenneth James KarisAllen, 60B Parkhill Rd., Halifax, Nova Scotia, Canada, B3P 1R5; Gordon Alexander Tynes, 1 Carolyns Way, Cole Harbour, Nova Scotia, Canada, B2Z 1C2

[21] Appl. No.: 09/174,888

[22] Filed: Oct. 19, 1998

[51] Int. Cl.[7] ..... E04C 3/12

[52] U.S. Cl. ..... 52/223.8; 52/223.9; 52/730.7; 52/745.19; 52/745.21; 428/114

[58] Field of Search ..... 52/223.1, 223.8, 52/223.9, 223.11, 730.7, 737.1, 737.3, 745.19, 745.21; 428/106, 114, 292.4; 156/160, 161, 178, 179; 264/229, 231

[56] References Cited

U.S. PATENT DOCUMENTS

| | | | |
|---|---|---|---|
| 2,827,414 | 3/1958 | Bussard et al. . | |
| 2,847,733 | 8/1958 | Roy | 428/114 |
| 3,046,180 | 7/1962 | Diehl et al. . | |
| 3,294,608 | 12/1966 | Peterson . | |
| 3,562,083 | 2/1971 | Schroder . | |
| 3,686,048 | 8/1972 | Schirtzinger . | |
| 3,935,047 | 1/1976 | Shinomura . | |
| 4,428,791 | 1/1984 | Reinke . | |
| 4,500,378 | 2/1985 | Reppel et al. . | |
| 4,615,163 | 10/1986 | Curtis et al. | 52/737.3 |
| 4,965,973 | 10/1990 | Engebretsen | 52/223.8 |
| 5,026,593 | 6/1991 | O'Brien | 428/114 X |
| 5,362,545 | 11/1994 | Tingley | 428/114 X |
| 5,429,693 | 7/1995 | Rose . | |
| 5,501,054 | 3/1996 | Soltis et al. | 52/730.7 |
| 5,565,257 | 10/1996 | Tingley | 428/114 |
| 5,725,929 | 3/1998 | Cooke et al. | 428/106 |
| 5,744,228 | 4/1998 | Tingley | 52/730.7 X |
| 5,910,352 | 6/1999 | Tingley | 52/730.7 X |
| 5,974,760 | 11/1999 | Tingley | 52/730.7 X |

FOREIGN PATENT DOCUMENTS

| | | | |
|---|---|---|---|
| 1447418 | 6/1966 | France | 52/730.1 |
| 2531656 | 2/1977 | Germany | 52/730.7 |
| 1596035 | 9/1990 | U.S.S.R. | 52/737.3 |

*Primary Examiner*—Laura A. Callo
*Attorney, Agent, or Firm*—Fasth Law Offices; Rolf Fasth

[57] ABSTRACT

An adhesive is applied to high strength fiber reinforcements and the first and second wood strands so that they together form a wood segment. Before the adhesive is cured, a simultaneous tension force is applied to the fiber reinforcements and an equilibrium compression force is applied to the first and second wood strands. The adhesive is cured while maintaining the tension force to the fiber reinforcements and the compression force to the wood strands. The prestressed wood composite laminate is attached to a tension zone of a wood member. The wood member has a tension zone and a compression zone so that a neutral plane is disposed between the tension zone and the compression zone.

15 Claims, 5 Drawing Sheets

PRESTRESSED WOOD COMPOSITE LAMINATE

TECHNICAL FIELD

The present invention relates to a prestressed wood composite laminate for use in glue laminated structural beams.

BACKGROUND AND SUMMARY OF THE INVENTION

The manufacturing of laminates and other wood members having wood laminates bonded together is known. Many attempts have been made in the past to increase and to improve the consistency of the properties of the laminates. It has been found that wood members have a tendency to fail catastrophically on the tension surface of the wood member. More particularly, conventional practices of fabricating wood members include bonding a plurality of wood laminates together to form a single structural member wherein the wood laminates are bonded together by an adhesive and the laminates may be conforming to a predefined geometry such as a unidirectional pattern.

Wood members that are manufactured to prior art principles normally fail on the tension surfaces of the wood member when the applied deflection of the wood member generates an outer fiber stress that exceeds the critical stress required to initiate and propagate fracture failure at the site of either a defect in the wood member such as a knot or a manufacturing defect such as a joint used to longitudinally attach the wood laminates to one another.

When a conventional wood member is subjected to a downwardly directed load at, for example, the mid-point of the wood member, a lower half of the thickness of the member is subjected to tension stresses while the upper half of the thickness of the member is subjected to compression stresses. When a wood member fails in the tension zone, i.e. in the lower half of the member if the member is subjected to a downward load, the failure can be catastrophic. However, a failure in the compression zone, i.e. upper half of the wood member, is a more benign mode of failure. Substantial amounts of FRP reinforcing laminates, such as carbon, aramid and glass fibers can be added to the tension zone or the wood member to shift the location of the (load) failure from the tension zone to the compression zone. Unfortunately, the FRP reinforcing laminates are not only very expensive but the reinforced members may be very labor intensive to make. It has been shown that reinforced wood members are most likely to fail adjacent to wood laminate defects such as knots and at finger joints.

Attempts in the past have focused on shifting the neutral axis towards the tension zone to reduce the outer tension fibers stresses as compared to non-reinforced members that are subjected to the same loading. For example, U.S. Pat. No. 5,362,545 to Tingley describes a wood member that has a FRP reinforcing material added exclusively to the tension side of the member. The current reinforcement technologies require a significant amount of expensive high performance FRP fiber laminates which in turn substantially increases the cost of the final product. Another deficiency of the current reinforcing technology is that the variance of failure load is not significantly reduced compared to conventionally sawn lumber technology partly due to the adverse affects of joint strength variability. Therefore, there is a need for a less costly and more reliable reinforcing method-of-wood members.

According to the method of the present invention, and adhesive is applied to high strength fiber reinforcements and the first and second wood strands to bond them together so that they form a wood composite laminate. Before the adhesive is cured, a tension force is applied to the high strength fiber reinforcements and an equilibrium compression force is applied to the first and second wood strands. The adhesive is cured while maintaining the tension force to the high strength fiber reinforcements and the compression force to the wood strands. The prestressed wood composite laminate may be attached to the tension zone of a wood body. The wood body has a tension zone and a compression zone so that a neutral plane is disposed between the tension zone and the compression zone.

DETAILED DESCRIPTION

Figure 1:
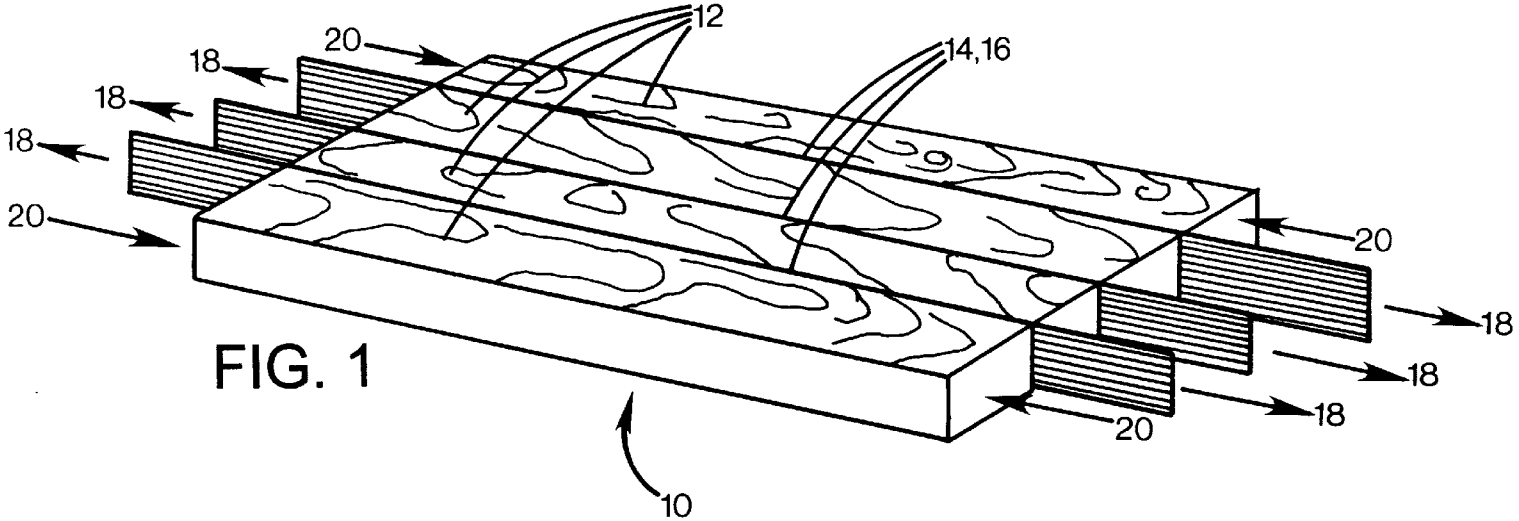
FIG. 1 is a perspective side view of the prestressed wood composite laminate of the present invention.
Figure 3:
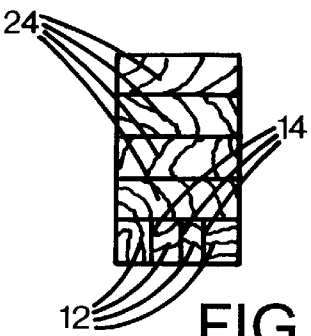
FIG. 3 is a cross-sectional view along line 3—3 in FIG. 2.

The present invention generally relates to the introduction of compressive residual stresses in a structural wood laminate by pre-stressing high strength reinforcements and the wood strands prior to adhesion therebetween to obtain higher stress and strain properties of the resulting prestressed wood composite laminate. The prestressed wood composite laminate may then be attached to a tension zone or a wood body to improve the overall strength/strain properties of the wood body.

With reference to FIGS. 1–7, a prestressed wood composite laminate 10 of the present invention comprises a plurality of lesser wood strands 12 having aligned high performance fiber reinforcements 14 placed therebetween. The wood strands 12 may be conventional naturally occurring wood structures of engineered wood strands having unidirectional or randomly oriented wood structures. Suitable softwood species for the wood strands 12 include, but are not limited to, eastern hemlock, eastern white pine, black spruce, white spruce and tamarack. It is to be understood that any other suitable wood species may be used.

Suitable high strength fiber reinforcements 14 include, but are not limited to, carbon, aramid and glass fibers in dry bulk, or as a reinforcement in a composite fiber FRP laminate or in any other suitable form. Metal strips and other suitable reinforcements may also be used. Preferably, the high strength fiber reinforcements 14 should have a tensile strength ranging from about 100 ksi to about 500 ksi. More preferred, the tensile strength should be between about 150 ksi and about 450 ksi. Most preferred the tensile strength should be between about 200 ksi and about 400 ksi. Preferably, the tensile modulus of the high strength fiber reinforcements 14 is between about 4 and about 50 msi. More preferred, the tensile modulus is between about 10 and about 35 Msi. Most preferred, the tensile modulus is between about 20 and about 30 Msi. In comparison, the tensile strength of wood, such as eastern spruce, is about 6.2 ksi and the average tensile modulus is about 1.5 Msi. In other words, the tensile strength of, for example, carbon fibers is almost a hundred times greater than the tensile strength of wood. The tensile modulus of carbon fibers is often more than ten time greater.

Of particular importance of the present invention is the tensile strength of the fiber reinforcements 14. The higher the tensile strength the less fiber reinforcements are required to obtain the same compressive prestress properties of the wood composite laminate 10. However, the tensile modulus of the fiber reinforcements 14 is also important because the wood composite laminate 10 obtains a portion of its strength enhancements from the modulus difference between the wood strands 12 and the high performance fibers 14.

Carbon and aramid fibers are the preferred fiber reinforcements for exterior applications because their fiber strength is not adversely affected by moisture. Carbon fibers are preferred over aramid fibers partly due to superior mechanical and fire rating properties of carbon fibers. However, from the standpoint of processability aramid fibers are preferred over both carbon and glass fibers. For interior applications, glass fibers are also acceptable. Glass fibers may also be used in exterior applications. However, the design strength of glass fibers must be appropriately adjusted for moisture effects. Other suitable fiber reinforcements include mechanically high strength polyethylene or any other suitable high strength or high modulus fibers. One drawback of polyethylene fibers is that the fire rating is relatively low.

Dry bulk fibers is the preferred form of high strength fiber reinforcements 14 of the present invention for many reasons. For example, the bulk fibers 14 may conveniently be introduced into the wood strands 12 in a single step process which significantly reduces the costs of the finished wood composite laminate 10 of the present invention compared to multiple steps processes where a FRP reinforcing laminate is manufactured and added to the wood strands in separate processes. Also, it has been found that dry bulk fibers applied in a single step provide excellent bond lines where the bulk fibers 14 and the wood strands 12 are bonded together by a suitable adhesive 16. The single step process also saves time and cost of preparing the FRP laminate surfaces of the fibers and wood strands to ensure proper bonding of the bulk fibers 14 to the wood strands 12.

The adhesive 16 may, of course, be applied to both the wood strands 12 and the bulk fibers 14 in two or more steps. A suitable adhesive 16 is, for example, a two part phenol resorcinol such as Lascophen LT 75 and Lascoset FM 260. In the preferred embodiment, the adhesive 16 is selected from a group consisting of phenol resorcinol, emulsion polymer isocyanate, epoxy and melamine based resin system. The adhesive 16 provides a suitable chemical bond between the fibers 14 and the wood strands 12 without having to rely to much on mechanical bonds therebetween. It is understood that any suitable adhesive may be used.

Before the adhesive 16 is permitted to cure but after the adhesive has been applied to the high strength fibers and the wood strands, tension stresses 10 are applied to the bulk fibers 14. As described below, the tension stresses on the high strength fibers may be adjusted to produce appropriate axial compressive stresses 20 on the wood strands 12. In the preferred method of the present invention, the tension and compressive stresses are simultaneously applied so that there is an equilibrium between the tension and the compression stresses.

Preferably, the compressive stresses 20 applied to the wood strands 12 are between about 500 psi and about 5,000 psi. Most preferred, the compressive stresses 20 are between about 1,000 psi and about 3,000 psi. For example, three different prestressed wood composite laminate products 10 may be produced that have different residual compressive stress properties applied thereto such as about 3,000 psi, 2,000 psi and 1,000 psi. In order to achieve these residual levels of compressive stress, the initially applied compressive stresses should be approximately 10–20% higher than the desired final compressive stress 20 depending upon which type of wood is used in the wood strands 12 and the amount of high strength fiber reinforcements 14 that are used. If the tension stresses 10 applied to the bulk fibers 14 are too high there is a risk of damaging the wood strands 12 if the resulting residual compressing stress exceeds, for example, 3,000 psi in eastern spruce strands the performance of the prestressed wood composite laminate 10 may not meet the design expectations. An important feature of the present invention is that the reaction of the tension stresses 18 is used to simultaneously transfer compressive forces or stresses 20 to the wood strands 12 so that the tension and compression stresses are in equilibrium.

The axial tension stresses 18 applied to the high strength fibers 14 and compression stresses 20 applied to the wood strands 12 should be symmetrically distributed across the composite wood laminate 10. If they are not, when the externally applied tension stresses 18 and the buckling constraints on the wood composite laminates are removed, some of the prestressed composite laminates 10, particularly long slender wood composite laminates, may buckle due to excessive localized compression stresses transferred thereto. However, the tension stresses applied to the high strength fibers 14 could be significantly higher than the compression stresses applied to the wood strands 12 if there is a high volume fraction of wood strands compared to the volume fraction of the high strength fibers 14 disposed in the prestressed wood composite laminate 10. The lower the volume fraction of the high strength fibers 14 the higher is the required tension stress that should be applied to the high strength fibers 14 to generate the desired compressive stress in the wood strands 12. Of course, if the volume fraction of the fibers 14 is very small compared to the volume fraction of the wood strands 12, the maximum tensile strength of the fibers may be exceeded before the desired compressive stress of the wood strands is achieved.

The compression stresses 20 applied to the wood strands 12 and the tension stresses 18 applied to the bulk high strength fibers 14 are held constant and in equilibrium while the adhesive 16 is permitted to cure.

The method of applying the tension stresses 18 and the compression stresses 20 may be either in a batch process or a continuous process. For example, a variety of prestressing batch methods may be used. In the preferred batch method, a hybrid pultrusion process may be used. Pultrusion is the preferred processing method partly because it is relatively easy to obtain the correct volume fraction of the high strength fibers 14 and amount of uncured adhesive 16 just prior to inserting the fibers 14 into the wood strands 12 and locking and laterally restraining the wood strands 12 mechanically while the fiber/wood/adhesive bond line cures. Other processing methods such as squeegees and rollers may also be used to achieve the proper volume fraction of fibers and adhesives.

In the hybrid pultrusion process, the high strength fibers 14 may first be strung on a fixture so that the ends of the fibers 14 are encapsulated in a pulling block. For example, about sixty 8050 dtex Twaron T2200 aramid fibers may be strung in each of three bundles. The ends of the bundles may then be encapsulated in, for example, a polyester resin matrix that is curable at room temperature. Each tow of high strength fibers is weighted while the fixture is held in the vertical position to ensure an even tension of the fibers 14. The pulling blocks are then filled with resin and the fibers are fixed in position.

When the resin in the pulling blocks is cured, the fiber bundles are wetted out with, for example, a resorcinol adhesive while being pultruded through a die having a cross sectional opening that is about 1"×0.15". Other suitable opening sizes may also be used. The pultrusion die may be used to impart a proper resin/fiber ratio.

The other ends of the fiber bundles may then be placed in a prestress fixture and approximately between about 300 lbs and about 700 lbs of tension may be applied to the fibers bundles. This may be accomplished by inserting several metal shims between the pulling block and the fixture frame. Subsequent wood strands may then be placed between the fiber bundles while maintaining an even vertical distribution of the fibers on the wood surfaces.

A small lateral load may be applied to the wood composite laminate to keep the fibers aligned. The metal shims may then be removed and a compressive load may be applied to the wood strands 12 with a hydraulic piston while simultaneously applying a tension force to the fiber bundles 14. The tension/compression relationship is maintained in equilibrium while the adhesive 16 is permitted to cure. Any remaining tension load is removed from the fiber bundles 14 leaving a compressive residual stress in the wood strands 12. The finished prestressed composite wood laminate 10 may then be removed from the prestress fixture and planed to a suitable size.

Figure 4:
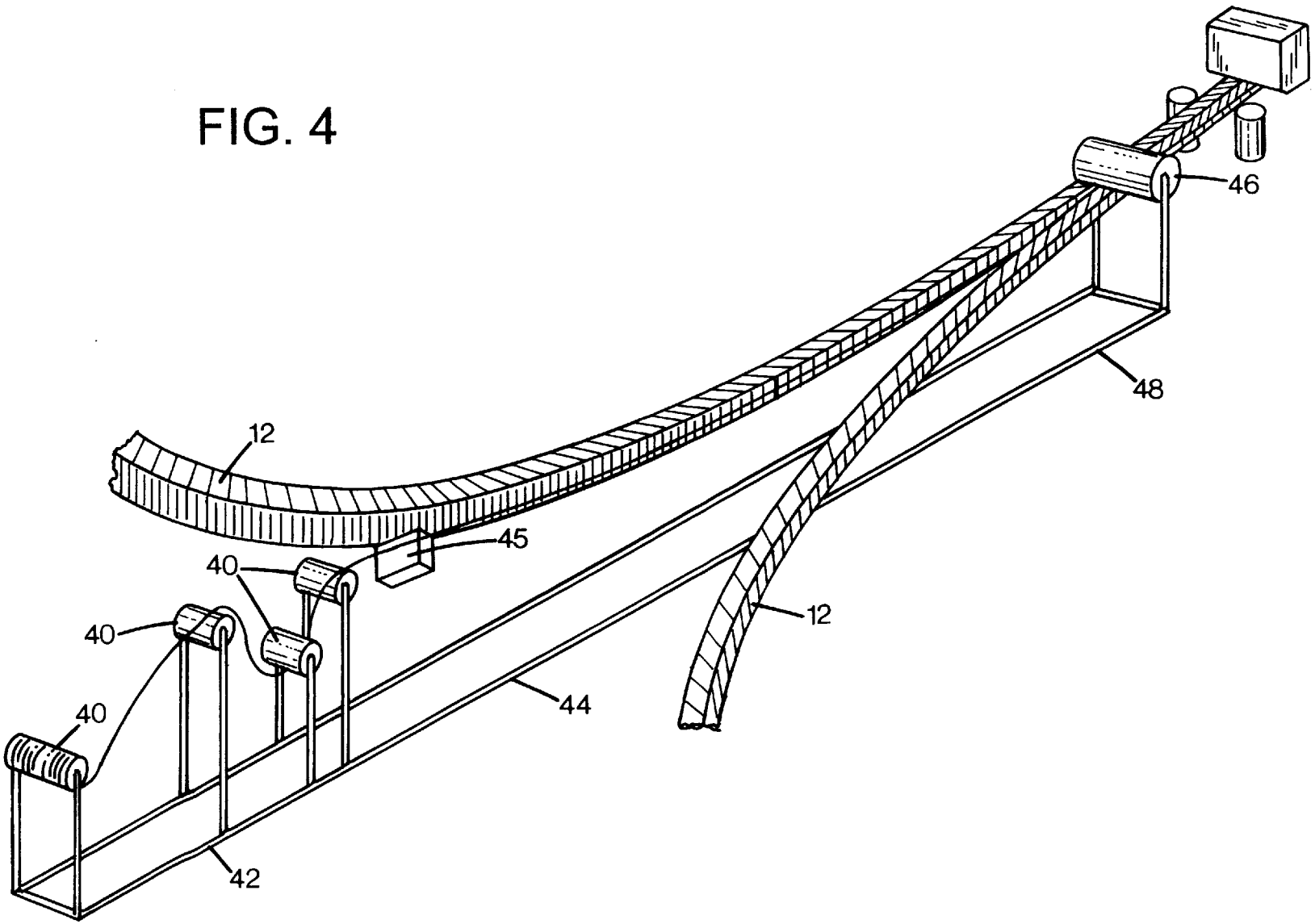
FIG. 4 is a schematic view of a continuous process of making the prestressed wood composite laminate of the present invention.
Figure 5:
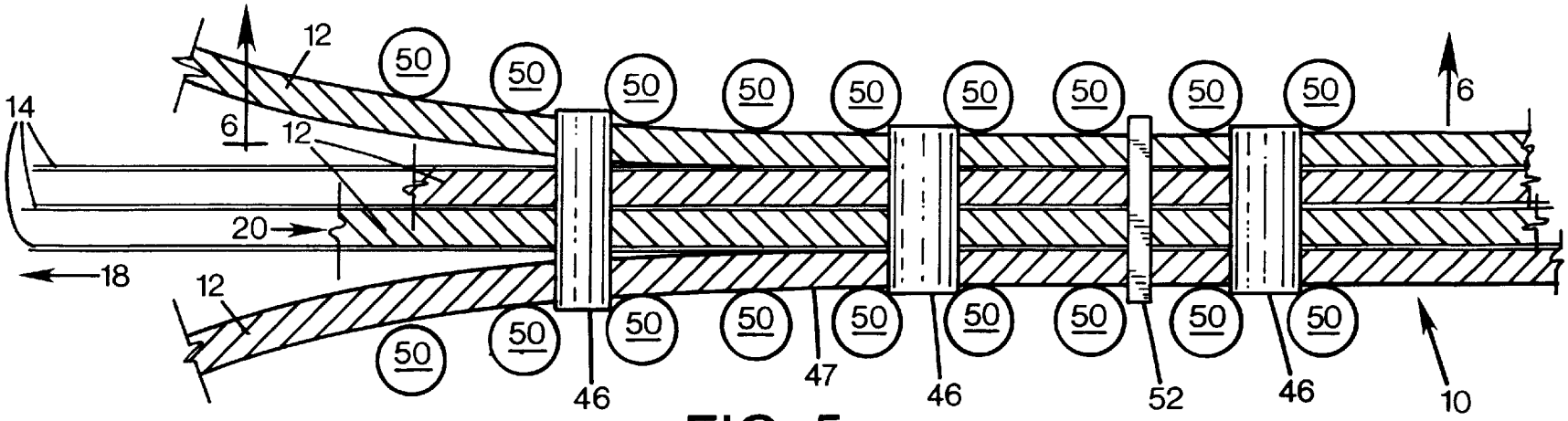
FIG. 5 is a detailed schematic view of the continuous process shown in FIG. 4.
Figure 6:
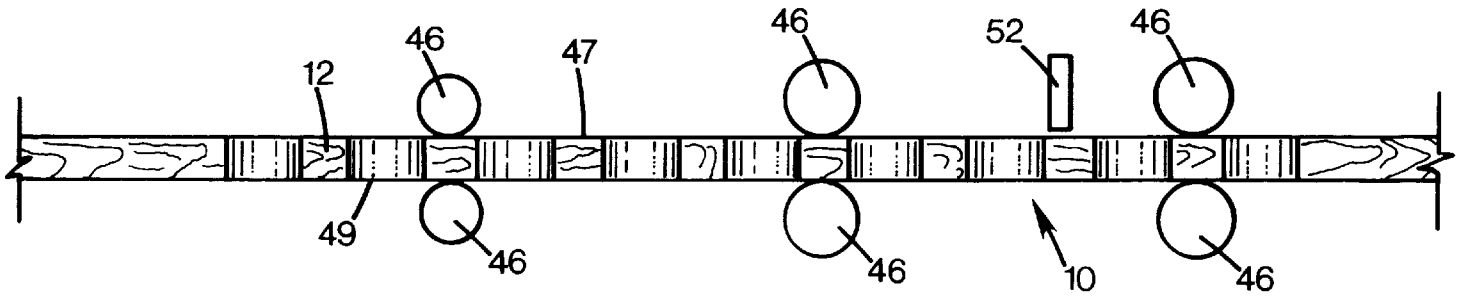
FIG. 6 is a sectional view along line 6—6 in FIG. 5.

When larger quantities of prestressed composite wood laminates are made, the preferred manufacturing method is a continuous process. A variety of continuous prestressing methods may be used. As best illustrated in FIGS. 4–6, fiber reinforcements 14, being subjected to a tension control by the fiber rolls, may be wetted out in a submersion tank and then collated into fiber bundles. For simplicity, FIG. 4 only illustrate one fiber bundle 14 that is guided by fiber rolls 40 attached to a back tension device 42 of a frame 44. For example, about sixty 8050 dtex Twaron T2200 aramid fibers may be strung in each fiber bundle 14. Carbon, glass and any other high performance fiber may also be used. Each fiber bundle 14 is then pultruded through a die 45 to generate the correct fiber/adhesive volume fraction. It has been shown that approximately 70–80% fiber by volume produces acceptable bond line properties. The die exits are preferably slotted to align the fibers bundles 14 between wood strands 12 which may be introduced adjacent to the fiber bundles 14. Drive rollers 46 are attached to a front end 48 of the frame 44. The drive rollers 46 are designed to exert a stress of up to about 3,300 psi on the wood strands 12 which is required to achieve a residual compression stress of about 3,000 psi in the wood strands 12. Because the drive rollers 46 are attached to the same frame 44 as the back tension device 42, the drive rollers 46 transfer the tension stresses 18 applied to the fiber bundles 14 to the wood strands 12 so that the tension stresses 18 are in equilibrium with the compression stresses 20 on the wood strands 12. Prior to applying tension stresses 18 on the fiber bundles 14, about twenty feet of the fiber bundles 14 and wood strands are consolidated without being under stress to anchor the fibers. The consolidated piece is driven passed the drive rollers 46 without being under tension stresses to stabilize the system before the tension forces are applied to the fiber bundles.

The wood strands 12 and the high strength fiber bundles 14 are, preferably, aligned such that the fibers bundles 14 are placed symmetrically across the cross section of the wood composite laminate 10. The wood strands 12 are driven axially away from the fiber rolls 40 using the single drive roller 46, as shown in FIG. 4, or a series of drive rollers 46, as shown in FIGS. 5 and 6, that may grip the wood strands 12 at the upper and lower surfaces 47, 49, respectively, thereof.

In this way, the tension stresses 10 generated at the fiber rolls 40 are transferred to the drive rollers 46 which provide the reaction point to generate the necessary compressive stresses 20 in the wood strands 12. The compression stresses 20 transferred to the wood strands 12 remain in the wood strands 12 after the adhesive 16 is cured.

As best shown in FIGS. 5 and 6, lateral non driving support rollers 50 may be provided along the length of the outer wood strands 12 to hold the wood strands 12 in place when the wood strands 12 are subjected to compression forces from the drive rollers 46. While the outer wood strands 12 of the wood composite laminate 10 are being supported by the support rollers 50, the adhesive in the wood composite laminate 10 may be cured using a thermal head source such as a RF heater 52. Once the wood composite laminate 10 is consolidated it may then be sectioned into the desired length with a radial saw.

The pre-stressed wood composite laminate 10 may then be adhered to a tension zone of a conventional wood member assembly 22 having to plurality of wood laminates 24 that may be subjected to a downward load 26 at their mid-point 28. The wood laminates 24 may be stacked and adhered to one another to form a wood laminate assembly 21.

Figure 2:
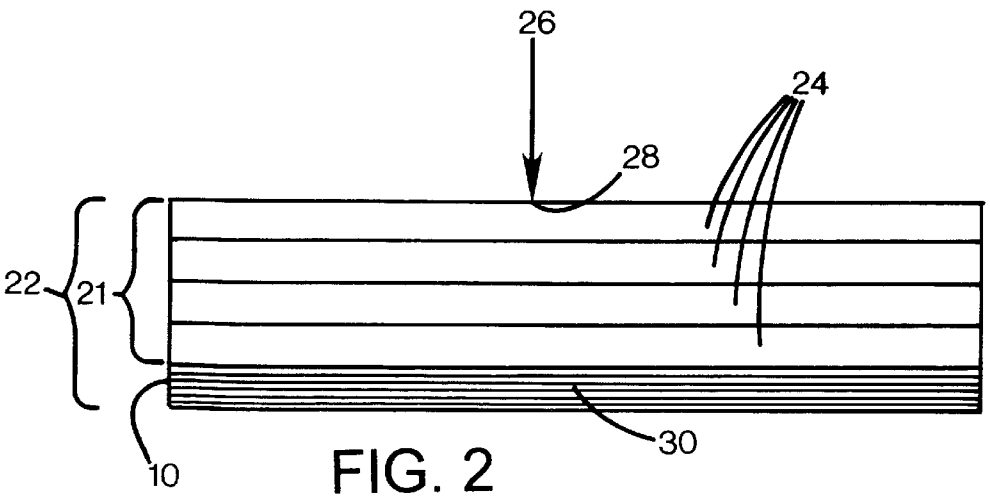
FIG. 2 is a front view of the prestress wood composite laminate attached to a wood body.

The pre-stressed wood composite laminate 10 is attached to the high tension zone 30 of the wood member assembly 22, subjecting the wood composite laminate 10 to the highest tension stresses. The bending stress may be applied to the wood composite laminate 10 in a direction that is perpendicular to the length of the wood composite laminate 10, as shown in FIG. 2.

To determine the property enhancements of the wood composite laminate 10 that are attributable to the method of the present invention, it is beneficial to compare the modulus of rupture. For example, in a base line test of a conventional wood laminate or eastern spruce generated an average bending failure stress of about 6,270 psi. The prestressed wood composite laminate 10 of the present invention generated an average failure stress in excess of 10,315 psi which is an increase of approximately 65% compared to the conventional wood laminate. Also, the coefficient of variation associated with the prestressed wood composite laminate 10 was lower.

There are at least three benefits to introducing a combination of high strength fiber reinforcements 14 and compressive prestresses 20 as far as increasing the overall strength/strain properties of the wood composite laminate 10. For example, by adding fiber reinforcements that have a significantly higher tensile modulus than the wood strands 12 and the wood members, the increase in the modulus of the reinforced wood composite laminate 10 is proportionate to the difference between the modulus of the fiber reinforcement 14 and the wood strands 12 and the volume fraction of the high strength fibers 14 compared to wood strands 12.

Another advantage is that the residual compressive stress/strain locked into the wood strands 12 enhances the overall stress strain characteristics of the wood composite laminate 10. The compressive residual wood strain increases the strain capacity of the finished wood composite laminate 10 by an amount that is governed by the stress/strain relationship of the wood strands 12.

The enhancement in wood composite laminate 10 failure stress is governed by the stress strain relationship of the high strength fiber reinforcement. The introduction of the compressive residual stresses 20 along the fiber/wood interfaces generates closure effects on any wood defects that may break the free surface of the wood strands 12 along the wood fiber interface. When the wood composite laminate 10 is subjected to applied tension deflections, the resulting applied stress intensity at the tip of the wood defect is reduced compared to an identically dimensioned but conventional wood laminate, having the identical defects, that has not been subjected to the compressive prestressing 20.

Figure 7:
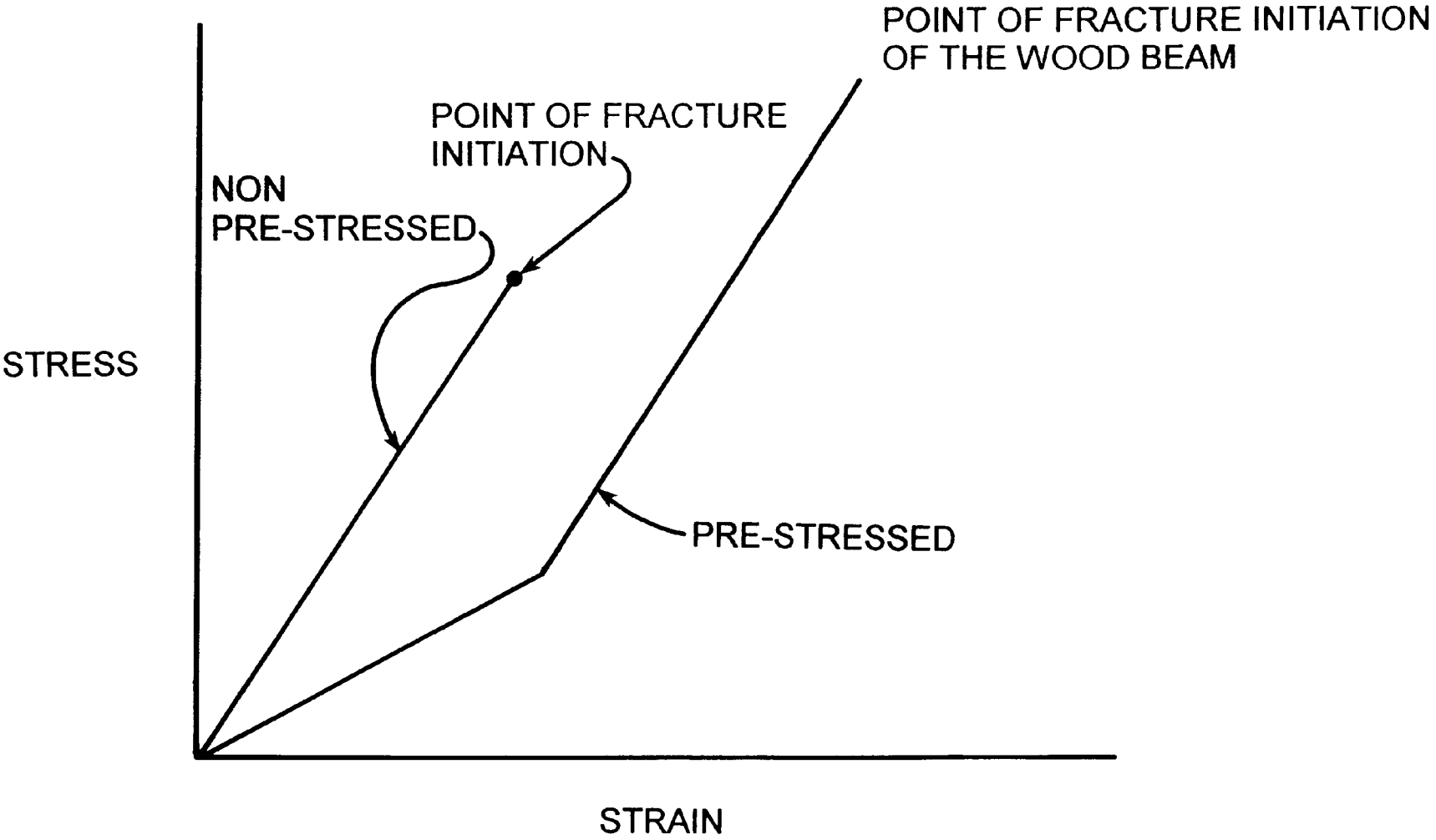
FIG. 7 is a schematic view showing stress/strain properties of a prestressed wood composite laminate of the present invention and a non-prestressed conventional wood laminate.

FIG. 7 shows a schematic representation of the stress/strain relationship for the prestressed wood composite laminate 10 of the present invention and a conventional non-prestressed wood laminate. Prestressing increases both the stress and strain required to initiate fracture failure in the defects or finger joints of the prestressed wood composite laminate 10. When the wood composite laminate 10 is adhered to the tension surface of the wood laminate 10 is adhered to the tension surface of the wood laminate member 22, see FIG. 2, the enhanced stress/strain properties of the wood composite laminate 10 promotes compression failure of the wood laminate member 22 which is a more benign type of failure.

The prestressed wood composite laminate 10 of the present invention provides outstanding stress and strain characteristics compared to conventional reinforced and non reinforced wood laminates. The prestressed wood composite laminate 10 may be used to replace conventional wood laminates in highly stresses tension zones in structural wood members. By increasing the ultimate applied stress and strain required to fail the outer wood tension laminates in the wood member, the ultimate load carrying capacity of the member is increased promoting compression failure of the wood member under bending stresses. The prestressed wood composite laminate 10 of the present invention may also improve the long term creep characteristics of a structural wood member that includes the prestressed wood composite laminate 10.

Figure 8:
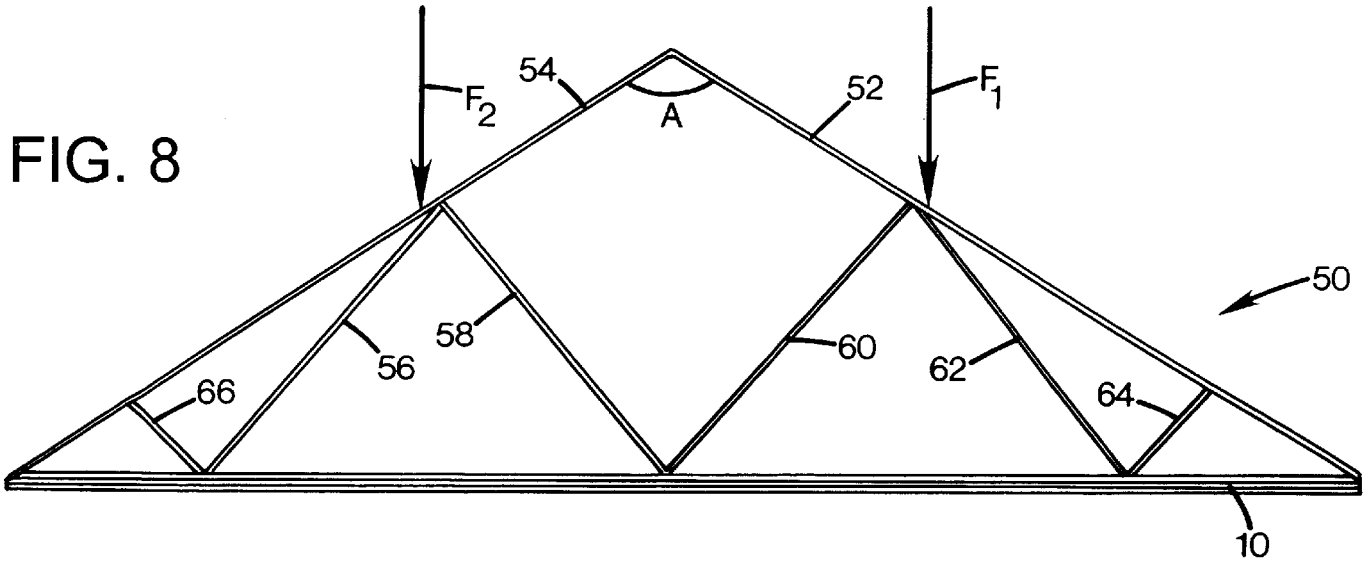
FIG. 8 is an elevational side view of a first embodiment of a truss including the prestressed wood composite laminate of the present invention.

With reference to FIG. 8, a triangular shaped truss 50 includes a first wood member 42, a second wood member 54 and the prestressed wood composite laminate 10. The first and second wood members 52, 54 are attached to another to form an obtuse angle A at the top of the truss 50 and the wood composite laminate 10 is attached to both wood members 52, 54 at bottom ends thereof. The truss is subjected to forces $F_1$ and $F_2$ so that the wood members 52, 54 are in compression and the wood composite laminate 10 is in tension. A plurality of struts 56–66 extend between the wood composite laminate 10 and the wood members 52, 54 to provide extra strength to the truss 50.

Figure 9:
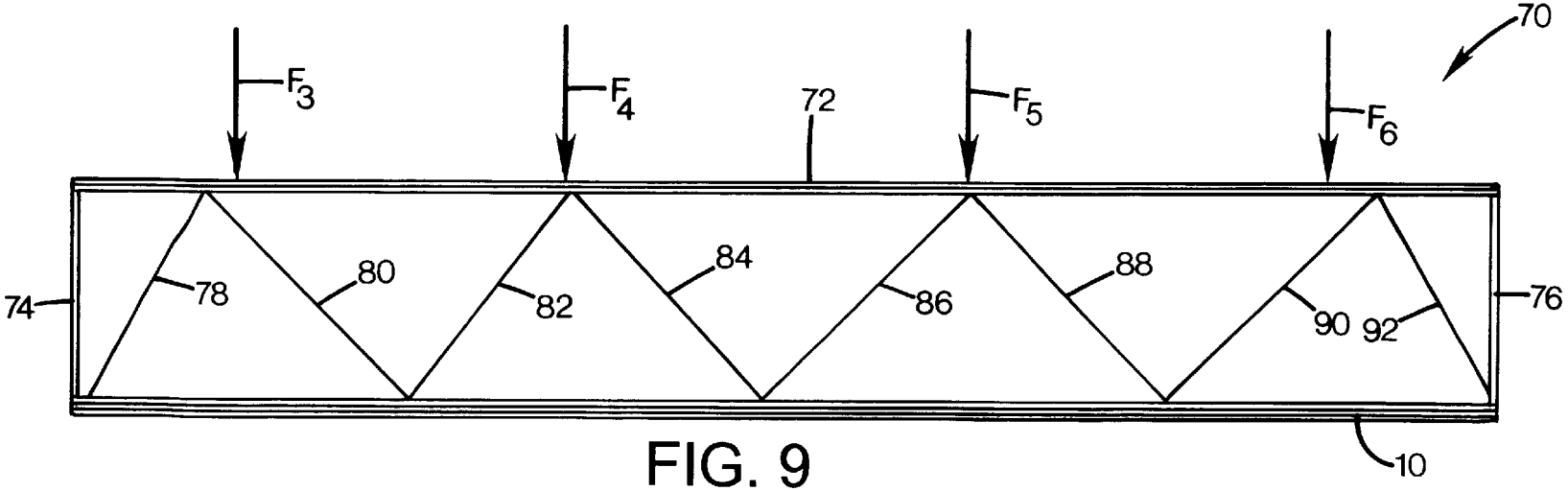
FIG. 9 is an elevational side view of a second embodiment of a truss including the prestressed wood composite laminate of the present invention.

With reference to FIG. 9, a rectangular shaped truss 70 includes a first wood member 72 that is substantially parallel to the prestressed wood composite laminate 10. Second and third wood members 74, 76 perpendicularly extend between the first wood member 72 and the wood composite laminate 10. A plurality of struts 78–92 angularly extend between the first wood member 72 and the wood composite laminate 10 to provide extra strength to the truss 70. The first wood member 72 is subjected to forces $F_3$–$F_6$ so that the first wood member 72 is in compression and the wood composite laminate 10 is in tension.

While the present invention has been described in accordance with preferred compositions and embodiments, it is to be understood that certain substitutions and alterations may be made thereto without departing from the spirit and scope of the following claims.

We claim:

1. A method of preparing a prestressed wood composite laminate assembly, comprising:

providing first and second wood strands, fiber reinforcement and a wood body having a tension zone and a compression zone so that neutral planes are disposed between the tension zone and the compression zone;

applying an adhesive to the fiber reinforcement and the first and second wood strands to form a wood composite laminate;

applying a tension force to the fiber reinforcement and a compression force to the first and second wood strands;

curing the adhesive while maintaining the tension force to the fiber reinforcement and the compression force to the wood strands to form a prestressed wood composite laminate; and attaching the prestressed wood composite laminate to the tension zone of the wood body.

2. The method of claim 1 wherein the method further comprises selecting the fiber reinforcement from a group consisting of aramid, carbon, glass and polyethylene fibers.

3. The method of claim 1 wherein the method further comprises selecting wood strands that have randomly oriented fibers.

4. The method of claim 1 wherein the method further comprises selecting wood strands that have directionally aligned fibers.

5. The method of claim 1 wherein the method further comprises selecting the adhesive from a group consisting of phenol resorcinol, emulsion polymer isocyanate, epoxy and melamine based resin system.

6. The method according the claim 1 wherein the step of providing the wood body comprises providing a wood laminate assembly having a first wood laminate and a second wood laminate stacked on top of one another so that the first wood laminate is in the compression zone and the second wood laminate is below the first wood laminate.

7. The method according to claim 1 wherein the method further comprises impregnating the fiber reinforcement with a resin matrix.

8. A method of preparing a prestressed wood composite laminate assembly, comprising:

providing first and second wood strands, fiber reinforcement and a wood body having tension and compression zones so that a neutral plane is disposed between the tension zone and the compression zone;

shifting the fiber reinforcement through a fixture;

attaching a first end of the fiber reinforcement to a first holding device;

vertically positioning the fixture to ensure even tension of the fiber reinforcement;

attaching an opposite second end of the fiber reinforcement to a second holding device;

wetting the fiber reinforcement in an adhesive;

inserting the wood strands adjacent to the fiber reinforcement;

applying a tension force to the fiber reinforcement;

applying a compression force to the first and second wood strands;

applying a lateral constraining force to the wood body;

maintaining the tension force to the fiber reinforcement and the compression force to the wood strands;

curing the adhesive to bond fiber reinforcement to the wood strands; and attaching the wood body to the wood strands.

9. The method according to claim 8 wherein the method further comprises aligning the fiber reinforcement with the wood strands prior to applying the compression force to the wood strands.

10. A method of continuously preparing a prestressed wood composite laminate, comprising the steps of:

providing first and second wood strands and a fiber reinforcement;

applying a tension force on the fiber reinforcement;

applying a compression force on the first and second wood strands with a drive roller so that the compression force and the tension force are in equilibrium;

while applying the compression force on the first and second wood strands, driving the first and second wood strands with the drive roller in a first direction;

while driving the first and second wood strands, applying a tension force on the fiber reinforcement, moving the fiber reinforcement in the first direction and placing the fiber reinforcement between the first and second wood strands; and while placing the fiber reinforcement between the first and second wood strands, permitting the fiber reinforcement to adhere to the first and second wood strands.

11. A wood member assembly, comprising:

an elongate laminated wood body having a first wood laminate disposed in a compression zone thereof, the first wood laminate being attached to a second wood laminate disposed in a tension zone of the wood body so that a neutral plane is disposed between the first wood laminate and the second wood laminate; and a prestressed wood composite laminate comprising a plurality of compressed wood strands and tensioned fiber reinforcements that are intermittently disposed relative to one another so that the compressed wood strands are separated by the tensioned fiber reinforcements, the prestressed wood composite laminate being attached to the laminated wood body.

12. The wood member assembly according to claim 11 wherein the prestressed wood composite laminate is adhered to the second wood laminate.

13. The wood member assembly according to claim 11 wherein the wood laminates have wood fibers oriented in a first direction and the prestressed wood composite laminate has wood strands and fiber reinforcement oriented in a second direction, the second direction is different from the first direction.

14. A reinforced wood truss, comprising:

a first wood member subjected to compression stresses, the first wood member having a first end extending in a first direction;

a second wood member subjected to compression stresses, the second wood member having a second end extending in a second direction, the first end being attached to the second end so that the first end and the second end form an obtuse angle therebetween;

a prestressed wood composite laminate extending in a third direction, the prestressed wood composite laminate comprising a plurality of compressed wood strands and tensioned fiber reinforcements that are intermittently disposed relative to one another so that the compressed wood strands are separated by the tensioned fiber reinforcements, the prestressed wood composite laminate being attached to the first and second wood members; and a strut extending between the prestressed wood composite laminate and the first wood member.

15. A reinforced wood truss, comprising:

a first wood member subjected to compression stresses, the first wood member extending in a first direction;

a prestressed wood composite laminate extending in the first direction, the prestressed wood composite laminate comprising a plurality of compressed wood strands and tensioned fiber reinforcements that are intermittently disposed relative to one another so that the compressed wood strands are separated by the tensioned fiber reinforcements, the prestressed wood composite laminate being attached to the first wood member, the prestressed wood composite laminate being spaced from the first wood member; and a strut extending between the prestressed wood composite laminate and the first wood member.

* * * * *